US007942557B2

(12) United States Patent
Zhou et al.

(10) Patent No.: US 7,942,557 B2
(45) Date of Patent: May 17, 2011

(54) LED LAMP HAVING ACTIVE HEAT DISSIPATION STRUCTURE

(75) Inventors: Zhi-Yong Zhou, Shenzhen (CN); Qiao-Li Ding, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 245 days.

(21) Appl. No.: 12/238,422

(22) Filed: Sep. 25, 2008

(65) Prior Publication Data

US 2009/0310372 A1 Dec. 17, 2009

(30) Foreign Application Priority Data

Jun. 13, 2008 (CN) ..... 2008 1 0067745

(51) Int. Cl.
*F21V 29/00* (2006.01)

(52) U.S. Cl. ..... 362/294; 362/615; 362/373

(58) Field of Classification Search ..... 362/294, 362/615, 373; 361/690, 701, 703, 709
See application file for complete search history.

(56) References Cited

U.S. PATENT DOCUMENTS

| | | | | |
|---|---|---|---|---|
| 6,122,169 | A * | 9/2000 | Liu et al. | 361/700 |
| 6,373,700 | B1 * | 4/2002 | Wang | 361/698 |
| 7,649,593 | B2 * | 1/2010 | Yoon et al. | 349/69 |
| 2007/0247817 | A1 * | 10/2007 | Huang | 361/719 |
| 2008/0019827 | A1 * | 1/2008 | Hirata | 415/206 |
| 2008/0048147 | A1 * | 2/2008 | Eaton | 252/74 |
| 2008/0158820 | A1 * | 7/2008 | Peng et al. | 361/703 |
| 2008/0192508 | A1 * | 8/2008 | Busby | 362/647 |

FOREIGN PATENT DOCUMENTS

| | | |
|---|---|---|
| CN | 2552062 Y | 5/2003 |
| JP | 200752950 A | 3/2007 |

* cited by examiner

*Primary Examiner* — Jong-Suk (James) Lee
*Assistant Examiner* — Mark Tsidulko
(74) *Attorney, Agent, or Firm* — Frank R. Niranjan

(57) ABSTRACT

An LED lamp includes a heat sink, a centrifugal blower and a plurality of LED modules. The heat sink includes a base plate defining an air intake adjacent to an end of the base plate and a plurality of fins extending downwardly from a bottom surface of the base plate, between the air intake and an opposite remote end of the base plate. The centrifugal blower is mounted on the bottom surface of the base plate and located between the air intake and the fins. The LED modules are fixed on a top surface of the base plate of the heat sink. The housing engages with the base plate to enclose the centrifugal blower and the fins therein and cooperates with the base plate to define an exhaust port between the opposite remote end of the base plate and a corresponding sidewall of the housing.

11 Claims, 3 Drawing Sheets

LED LAMP HAVING ACTIVE HEAT DISSIPATION STRUCTURE

BACKGROUND OF THE INVENTION

1. Field of the Invention

The present invention relates to an LED lamp, and particularly to an LED lamp having an active heat dissipation structure for dissipating heat from LEDs thereof.

2. Description of Related Art

An LED lamp is a type of solid state lighting that utilizes light-emitting diodes (LEDs) as a source of illumination. An LED is a device for transferring electricity to light by using a theory that, if a current is made to flow in a forward direction in a junction region comprising two different semiconductors, electrons and cavities are coupled at the junction region to generate a light beam. The LED has an advantage in that it is resistant to shock, and has an almost eternal lifetime under a specific condition; thus, the LED lamp is intended to be a cost-effective yet high quality replacement for incandescent and fluorescent lamps.

An LED lamp generally requires a plurality of LEDs, and most of the LEDs are driven at the same time, which results in a quick rise in temperature of the LED lamp. Since generally the LED lamp does not have a heat dissipation device with a good heat dissipating efficiency, operation of the LED lamp has a problem of instability because of the rapid increase of heat. In addiction, the LEDs functioning as a light source of the LED lamp are commonly used in an enclosed housing or a sealed light module to provide directed light. As there is no airflow in the enclosed housing or the sealed light module, heat generated by the LEDs can not be easily and timely removed from the LEDs. Consequently, the light from the LED lamp often flickers, which degrades the quality of the illumination. Furthermore, the LED lamp is used in a high heat state for a long time and the life time thereof is consequently shortened.

What is needed, therefore, is an LED lamp which has an active heat dissipation structure with a great heat-dissipation capability.

SUMMARY OF THE INVENTION

An LED lamp includes a heat sink, a centrifugal blower and a plurality of LED modules. The heat sink includes a base plate defining an air intake adjacent to an end of the base plate and a plurality fins extending downwardly from a bottom surface of the base plate. A plurality of air passages are defined between every two neighboring ones of the fins and extend from the air intake to another opposite end of the base plate. The centrifugal blower is mounted on the bottom surface of the base plate and located between the air intake and the air passages. The LED modules are fixed on a top surface of the base plate. The housing engages with the base plate to enclose the centrifugal blower and the fins therein and cooperates with the base plate to define an exhaust port between the another end of the base plate remote from the air intake and a corresponding sidewall of the housing.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE INVENTION

Figure 1:
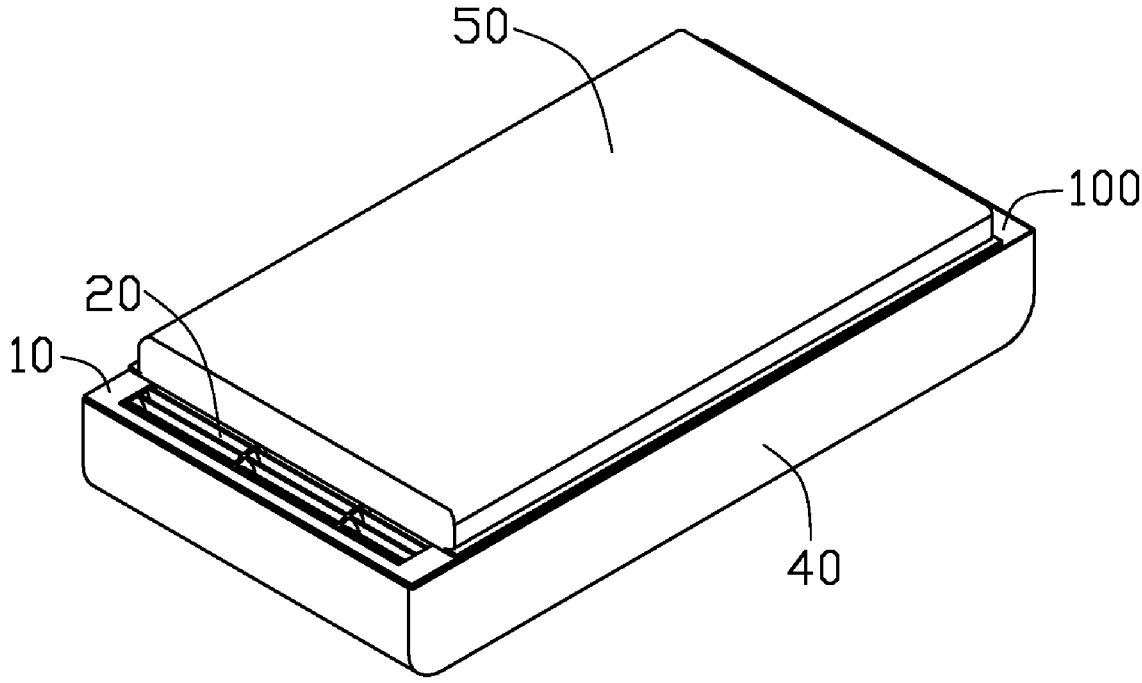
FIG. 1 is an isometric, assembled view of an LED lamp in accordance with a preferred embodiment of the present invention.
Figure 2:
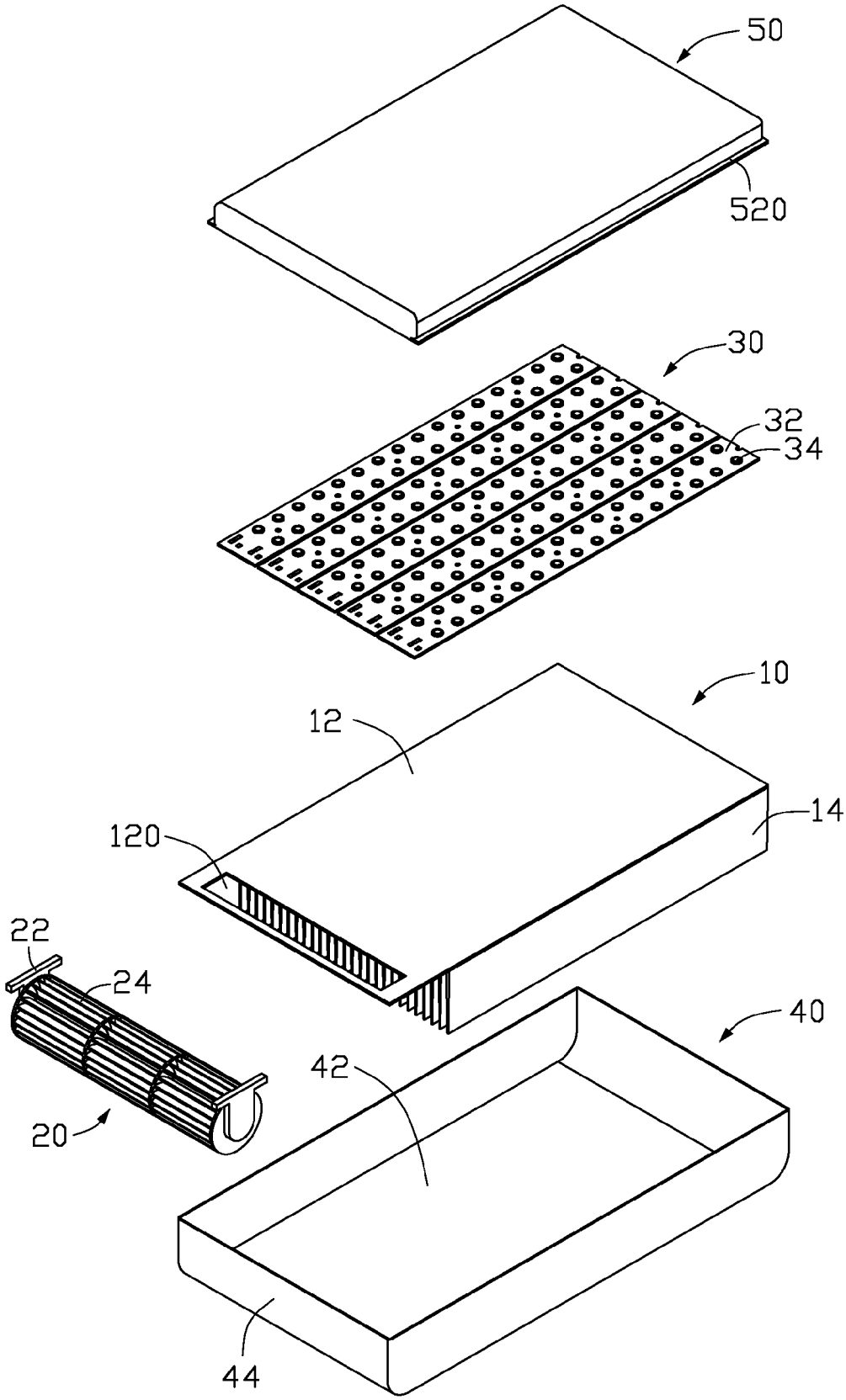
FIG. 2 is an exploded view of FIG. 1.
Figure 3:
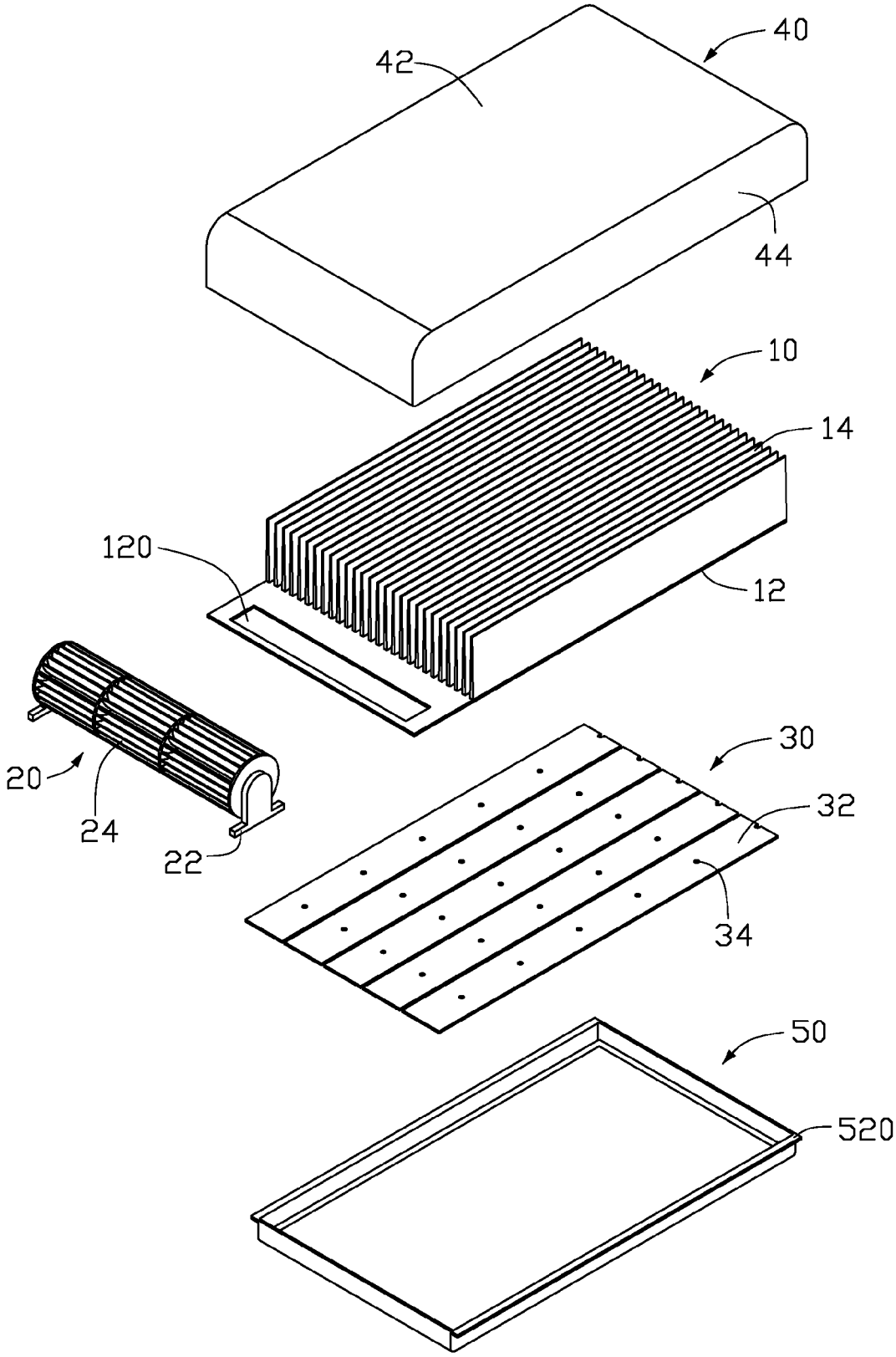
FIG. 3 is an inverted view of FIG. 2.

Referring to FIGS. 1-3, an LED lamp in accordance with a preferred embodiment of the present invention comprises a heat sink 10, a centrifugal blower 20 mounted at a bottom lateral side of the heat sink 10, a plurality of LED modules 30 mounted on a top of the heat sink 10, a housing 40 enclosing the centrifugal blower 20 and the heat sink 10 and a covering member 50 fixed on the top of the heat sink 10 and covering the LED modules 30.

The heat sink 10 is made of a material with a high heat conductivity and comprises a base plate 12 and a plurality of fins 14 arranged on a bottom surface of the base plate 12. The base plate 12 is rectangular and defines an air intake 120 therein corresponding to the centrifugal blower 20. The air intake 120 is rectangular strip-shaped, adjacent to a short side of the base plate 12 and has two long sides edges parallel to the two short side edges of the base plate 12. The fins 14 extend downwardly from the bottom surface of the base plate 12 and are spaced from each other to define a plurality of elongated air passages between every two neighboring ones thereof. The fins 14 are located parallel to two long side edges of the base plate 12 and beside the air intake 120 with the air passages oriented to the air intake 120.

The centrifugal blower 20 is fixed on the bottom surface of the base plate 12 and located beneath the air intake 120 of the base plate 12 and between the air intake 120 and the air passages of the fins 14. The centrifugal blower 20 comprises two mounting legs 22 and a blowing member 24 between the two mounting legs 22. The mounting legs 22 are directly attached to the bottom surface of the base plate 12 and located adjacent to two short sides of the air intake 120 of the base plate 12. The blowing member 24 is located right beneath the air intake 120 of the base plate 12 and securely held by the mounting legs 22.

The LED modules 30 are attached to a top surface of the base plate 12 and arranged closely side by side to each other. Each of the LED modules 30 comprises an elongated printed circuit board 32 and a plurality of LEDs 34 mounted on the printed circuit board 32 and arranged in a line along a lengthways direction of the printed circuit board 32. The printed circuit boards 32 are secured on the top surface of the base plate 12 and parallel to two long side edges of the base plate 12 of the heat sink 10.

The housing 40 is cuboid-shaped and has an opening (not labeled) facing the fins 14 of the heat sink 10. The housing 40 engages with the base plate 12 to enclose the centrifugal blower 20 and the fins 14 therein. The housing 40 comprises a rectangular covering plate 42 and four sidewalls 44 extending perpendicularly and upwardly from four side edges of the covering plate 42. Top edges of the sidewalls 44 are securely fixed to corresponding edges of the base plate 12, except a top edge of a short sidewall 44 remote from the centrifugal blower 20. The top edge of the remote short sidewall 44 projects outside the corresponding short side edge of the base plate 12 to define an exhaust port 100 (particularly shown in FIG. 1) between the remote short sidewall 44 and the short side edge of the base plate 12. Two junctures between the two short sidewalls 44 and the two long sidewalls 44 at two corners of the housing 40 corresponding to each of the air intake 120 and the exhaust port 100 are configured to be arch-shaped, whereby airflow can be more smoothly driven into the air passages between the fins 14 by the centrifugal blower 20 via the air intake 120. Furthermore, the airflow can be more smoothly expelled out of the LED lamp via the exhaust port 100 after the airflow has flown through the air passages between the fins 14.

The covering member 50 is made of transparent/translucent plastic or glass and fitly covers the LED modules 30. Bottom edges of the covering member 50 surrounding the LED modules 30 are attached to the top surface of the base plate 12 and located beside the air intake 120 of the base plate 12. The bottom edges of the covering member 50 have two engaging flanges 520 extending horizontally and outwardly therefrom. The engaging flanges 520 are securely attached to the top surface of the base plate 12 to enhance a connection between the covering member 50 and the base plate 12 of the heat sink 10.

In use of the LED lamp, the LED modules 30 are hermetically enclosed in a sealed space formed by the covering member 50 and the base plate 12 of the heat sink 10 and thus can be protected from harm and contamination of rainwater and dusty. The LED lamp is provided with an air path in the housing 40 from the air intake 120 located in an end of the base plate 12 through the fins 14 to the exhaust port 100 in another opposite end of the base plate 12. Thus, the airflow accelerated by the centrifugal blower 20 enters the air intake 120 of the base plate 12 and then flows through the air passages of the fins 14 to directly contact with the fins 14 to take heat accumulated in the fins 14 away to ambient air. Accordingly, the accelerated airflow recycling in the air path in the LED lamp can quickly and efficiently remove heat generated by the LEDs 34 into ambient air to enable the LEDs 34 to work in a cool condition. Thus, a life-span of the LED lamp can be extended.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base plate defining an air intake adjacent to an end of the base plate and plurality of fins extending downwardly from a bottom surface of the base plate, a plurality of air passages defined between every two neighboring ones of the fins and extending from the air intake to another opposite end of the base plate;

a centrifugal blower mounted on the bottom surface of the base plate and located between the air intake and the air passages;

a plurality of LED modules fixed on a top surface of the base plate; and a housing engaging with the base plate to enclose the centrifugal blower and the fins therein and cooperating with the base plate to define an exhaust port between the another opposite end of the base plate remote from the air intake and a corresponding sidewall of the housing;

wherein the housing comprises a covering plate and four sidewalls extending upwardly from four side edges of the covering plate and surrounding the fins and the centrifugal blower;

wherein top edges of the sidewalls of the housing are fixed to corresponding edges of the base plate, except a top edge of a short one of the sidewalls remote from the centrifugal blower, which projects outside a corresponding side edge of the base plate to thereby define the exhaust port between the short one of the sidewalls remote from the centrifugal blower and the corresponding side edge of the base plate;

a covering member fixed on the top surface of the base plate, located between the air intake and the exhaust port and covering the LED modules therein.

2. The LED lamp of claim 1, wherein the centrifugal blower is located beneath the air intake, beside the fins and facing directly to openings of the air passages.

3. The LED lamp of claim 1, wherein the base plate is rectangular, the air intake is rectangular-shaped, adjacent to a short side of the base plate and has two long side edges parallel to the short side of the base plate.

4. The LED lamp of claim 3, wherein the fins are perpendicular to the base plate and parallel to two long side edges of the base plate.

5. The LED lamp of claim 1, wherein junctures between the sidewalls of the housing are arch-shaped.

6. The LED lamp of claim 1, wherein the centrifugal blower comprises two mounting legs located at two opposite sides of the air intake and a blowing member between the two mounting legs and beneath the air intake and held by the mounting legs.

7. The LED lamp of claim 1, wherein the LED modules comprise a plurality of elongated printed circuit boards attached to the top surface of the base plate side by side to each other and a plurality of LEDs mounted on each of the printed circuit boards and arranged in a line along a lengthways direction of the each of the printed circuit boards.

8. An LED lamp comprising:

a heat sink comprising a base plate defining an air intake adjacent to an end of the base plate and plurality of fins beside the air intake and extending downwardly from a bottom surface of the base plate, a plurality of air passages defined between every two neighboring ones of the fins and extending from the air intake to another opposite end of the base plate;

a centrifugal blower mounted on the bottom surface of the base plate, beneath the air intake and between the air intake and the air passages;

a plurality of LED modules fixed on the top surface of the base plate; and a housing engaging with the base plate to enclose the centrifugal blower and the fins therein and cooperating with the base plate to define an exhaust port between the another opposite end of the base plate remote from the air intake and a corresponding sidewall of the housing;

wherein the housing comprises a covering plate and four sidewalls extending upwardly from four side edges of the covering plate and surrounding the fins and the centrifugal blower;

wherein top edges of the sidewalls are securely fixed to corresponding edges of the base plate, except a top edge of a short one of the sidewalls, which is remote from the centrifugal blower and projects outside a corresponding side edge of the base plate to define the exhaust port between the short one of the sidewalls and the corresponding side edge of the base plate;

a covering member fixed on the top surface of the base plate, located between the air intake and the exhaust port and covering the LED modules therein.

9. The LED lamp of claim 8, wherein the base plate is rectangular, the air intake is rectangular-shaped, adjacent to a short side of the base plate and has two long sides edges parallel to the short side of the base plate.

10. The LED lamp of claim 8, wherein the fins are perpendicular to the base plate and parallel to two long side edges of the base plate.

11. The LED lamp of claim 8, wherein junctures between the sidewalls of the housing are arch-shaped for guiding an airflow generated by the centrifugal blower through the air passages of the fins.

* * * * *